US005153953A

United States Patent [19]

Sumrall

[11] Patent Number: 5,153,953

[45] Date of Patent: Oct. 13, 1992

[54] APPARATUS FOR TRANSFER OF THE DISABLED

[76] Inventor: Joe L. Sumrall, 300 Honeysuckle Dr., Hattiesburg, Miss. 39402

[21] Appl. No.: 722,116

[22] Filed: Jun. 27, 1991

[51] Int. Cl.[5] ..... A61G 7/10

[52] U.S. Cl. ..... 5/86.1; 5/83.1; 5/81.1

[58] Field of Search ..... 5/81 R, 83, 86, 87, 5/89

[56] References Cited

U.S. PATENT DOCUMENTS

| | | | |
|---|---|---|---|
| 2,962,730 | 12/1960 | Carnes et al. | 5/86 |
| 3,205,512 | 9/1965 | Camper | 5/86 |
| 3,407,413 | 10/1968 | James | 5/81 R |
| 3,914,808 | 10/1975 | Woods | 5/86 |
| 4,510,633 | 4/1985 | Thorne | 5/86 X |
| 4,999,862 | 3/1991 | Hefty | 5/86 X |

*Primary Examiner*—Michael F. Trettel
*Attorney, Agent, or Firm*—Alexander Norcross

[57] ABSTRACT

A lifting and loading device for the disabled is movable on casters mounted on a U shaped base. A pair of lifting bars form a supporting fork, mounted at right angles to the base, are vertically jackable from the base. The supporting fork is raised or lowered with a crank operated mechanical jack. A seating pad for use under the disabled person in a wheel chair or car seat is connected to the elevating fork by straps which hook to the lifting bars. The fork provides additional support to the disabled person by being positioned at chest level. The entire apparatus is assembled of stacked components, which are held together by gravity, and may be easily assembled and disassembled for ready movement and storage.

14 Claims, 7 Drawing Sheets

APPARATUS FOR TRANSFER OF THE DISABLED

BACKGROUND OF THE INVENTION

This invention relates to devices for lifting and moving disabled persons.

There is a need for a compact device for transferring disabled persons to and from automobiles, seats, wheelchairs, etc. Often this transfer must be accomplished by a single attendant, who may not have the strength to move either the disabled person or a heavy apparatus. When an attempt is made to move a disabled person by a single weak attendant, there is a real danger of injury to the disabled person, the attendant or both. Further, in the common case of a spouse attempting to move a disabled spouse, for routine care or in an emergency, common devices designed for skilled nursing attendants are inappropriate, and sometimes unusable.

Devices exist to aid in the transfer of disabled patients, but they are usually too bulky to be easily moved and used in the home or with a vehicle. These devices may additionally weigh too much to be easily moved by a single attendant. Many of these devices lack the compactness needed to manuever a patient in confined spaces, such as occurs when a disabled person is placed in the passenger seat of a standard automobile.

Such devices are shown in the following U.S. Patents:

U.S. Pat. No. 3,137,011 to Fischer discloses a patient lift for a wheelchair borne patient having a U-shaped base channel mounted on dolly wheels within which a wheel chair can be rolled and having a vertically extending jacking member mounted from the side of this base with a bar and crane to lift the patient in a chained suspended seat. This patent has no rear support and thus no means, other than an optional back sling, to prevent the individual against falling backwards. It also shows an inclined angled lift, a structure at or above the head level of the individual. It does show (FIG. 2) the use of a jack screw device for elevating and lowering the patient.

U.S. Pat. No. 4,574,410 for a patient lift discloses a fixed seat located on a transverse base member. The seat, once jacked, can be slid back and forth between two extreme positions.

U.S. Pat. No. 4,399,572 to Johansson discloses a patient lift having fore and aft bars together with a vertical jacking member. This patent is for the design of the seat and thus there is no disclosure of the support bars labeled D and E or 47 and 48. Johansson teaches the desirability of an additional, optional support strap around a patient to prevent the patient from falling from the device.

U.S. Pat. No. 3,914,808 to Woods teaches a transport device having a vertically jacked bar and a sling suspended between two arms on the bar. This device shows a foot pedal jack, items 81, 73, wherein two foot pedals control a hydraulic lifting cylinder to pump it up or to release it.

U.S. Pat. 4,890,853 to Olson discloses a wheelchair walker having a U-shaped base member, a hydraulic post for height adjustment and a U-shaped cloth covered frame as a patient seat.

U.S. Pat. No. 2,666,212 to Flanders discloses a mobile elevator consisting of an overhead crane supporting a sling sheet.

German Patent 202646 to Lohfink and Wegner shows a sling seat elevated by a rack and pinion rachet with gear lock.

U.S. Pat. No. 4,920,950 to Weiner discloses a wheeled apparatus for lifting an invalid. having an overhead crane described as a cantilever.

In terms of the specific problem of loading a patient into a vehicle through a swing open door, under a limited overhead, nothing in this art teaches a readily movable unit which lifts a patient without the use of an overhead apparatus, and none of the units show sufficient upper body support to prevent a disabled person from falling over.

SUMMARY OF THE INVENTION

I disclose a hand crank apparatus for assisting a totally disabled person from a wheel chair into the seat of a car. A lifting and loading device for the disabled is movable on casters mounted on a U shaped base. A pair of lifting bars form a supporting fork, mounted at right angles to the base, are vertically jackable from the base. The supporting fork is raised or lowered with a crank operated mechanical jack. A seating pad for use under the disabled person in a wheel chair or car seat is connected to the elevating fork by straps which hook to the lifting bars. The fork provides additional support to the disabled person by being positioned at chest level. The entire apparatus is assembled of stacked components, which are held together by gravity, and may be easily assembled and disassembled for ready movement and storage.

The elevating fork is at right angles to the base channel member.

In use, the unit is rolled next to the open door of a car. A wheel chair may then be rolled into the opening of the base. The elevating fork is then lowered around the person to be moved until the arms are low enough to hook to a canvas seat or cushion in the wheel chair upon which the person sits. Once the seat is hooked to the elevating arm, the assisting individual then cranks sufficiently to lift the individual slightly from the wheel chair permitting the wheel chair to be pulled away from and out of base. The base may then be rolled under the car; the suspended patient, cradled within the elevating arms, thus is slid over the car seat and can then be lowered into the car seat.

No portion of the apparatus which extends into the car is above the level of the shoulders of the person being transported, as there is no space normally within a car or van above the passenger which would permit the passenger to be lifted. The enfolding arms also provide a degree of reassurance and support for the disabled person.

Both the base and the elevating mechanism may be made of hollow steel or aluminum tubing and may be formed as a telescoping structure that can be readily disassembled and placed in the trunk of a car. The gear ratio on the jack may be made high enough so that the invention may be easily used by any person. This is important since as the most typical transportation problem is an elderly disabled person who must be lifted and transported by an equally elderly spouse who lacks the physical strength to move anything weighing much over twenty-five pounds.

It is important to note that it is not necessary to lift the person a great distance, merely high enough so that the wheel chair can be removed and the person can be slid in and then lowered into a car seat. Normal cranking distances are on the order of four to eight inches maximum under these circumstances and typically are less.

It is thus an object of the invention to provide a lifting and transporting device which is safe both for the disabled person and for the attendant.

It is a further object of the invention to provide a lifting and transporting device which enables a single person to readily lift and move a disabled person.

It is a further object of the invention to provide a lifting and transporting device which will readily lift and transfer a disabled person into a confined or restricted space, such as an automobile.

It is a further object of the invention to provide a lifting and transporting device which may be easily moved, stored, or set up by relatively unskilled or weak persons.

It is a further object of the invention to provide a lifting and transporting device which is easily and inexpensively manufactured, with minimum complexity.

It is a further object of the invention to provide a lifting and transporting device which may be readily disassembled for storage and carriage in a standard passenger automobile.

These and other objects of the invention may be readily seen from the detailed description of the preferred embodiment.

DETAILED DESCRIPTION OF THE PREFERRED EMBODIMENT

Figure 1:
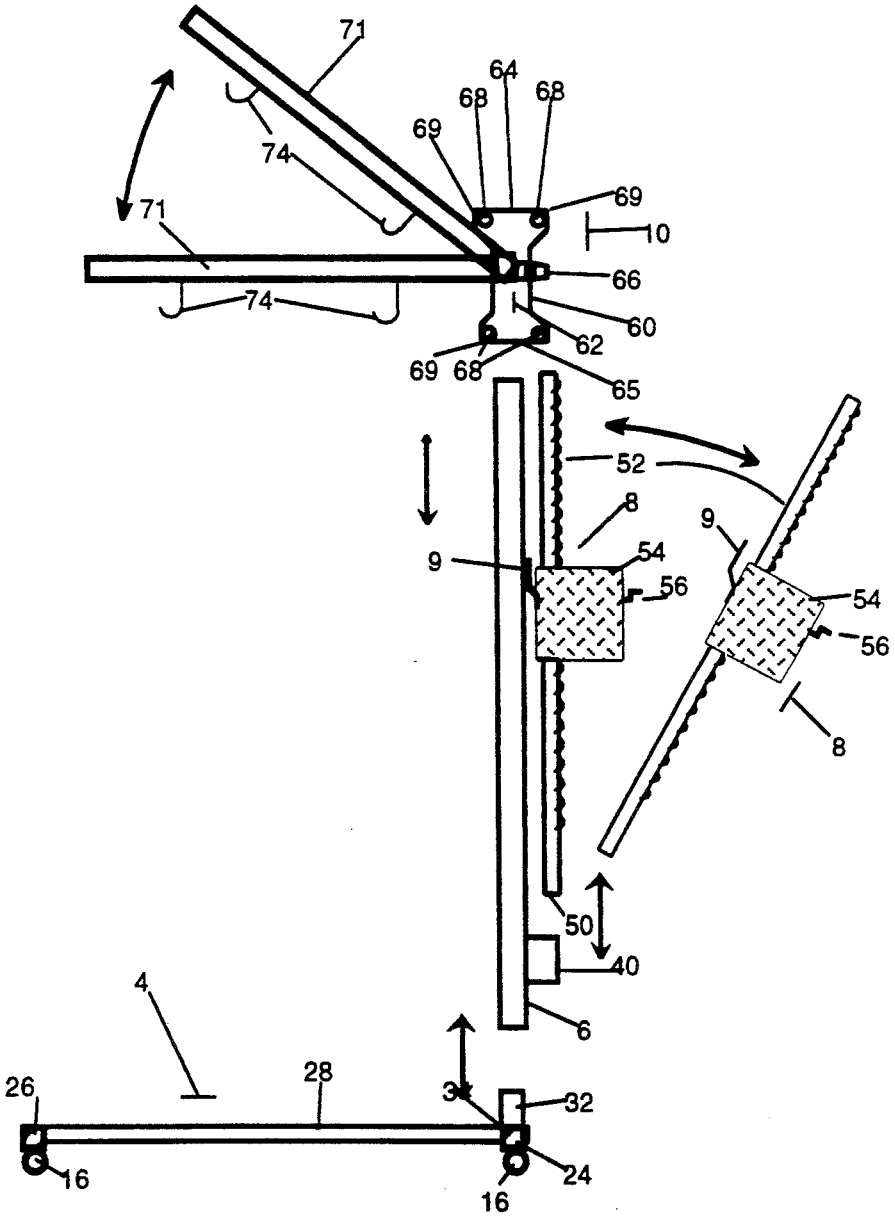
FIG. 1 is an exploded view, from the open end, of the invention.
Figure 2:
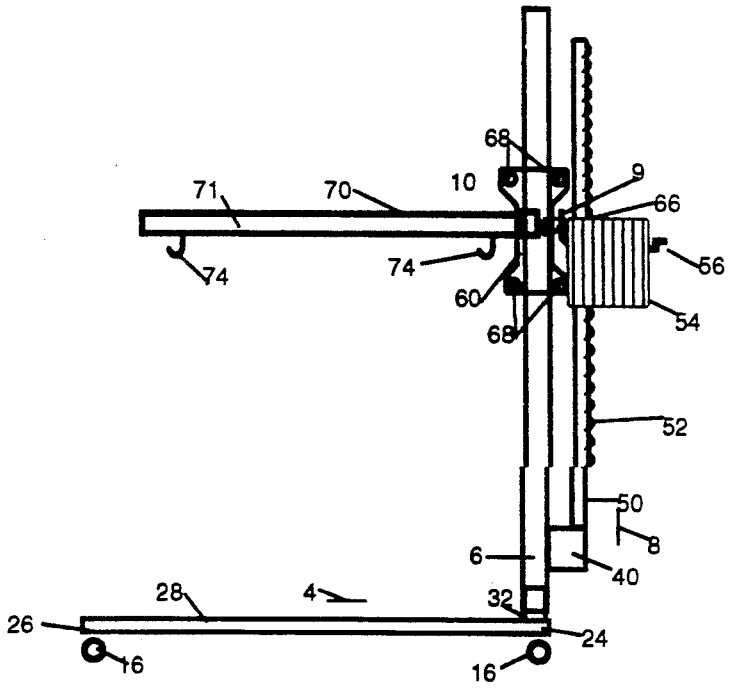
FIG. 2 is an assembled view, from the open end, of the invention.
Figure 3:
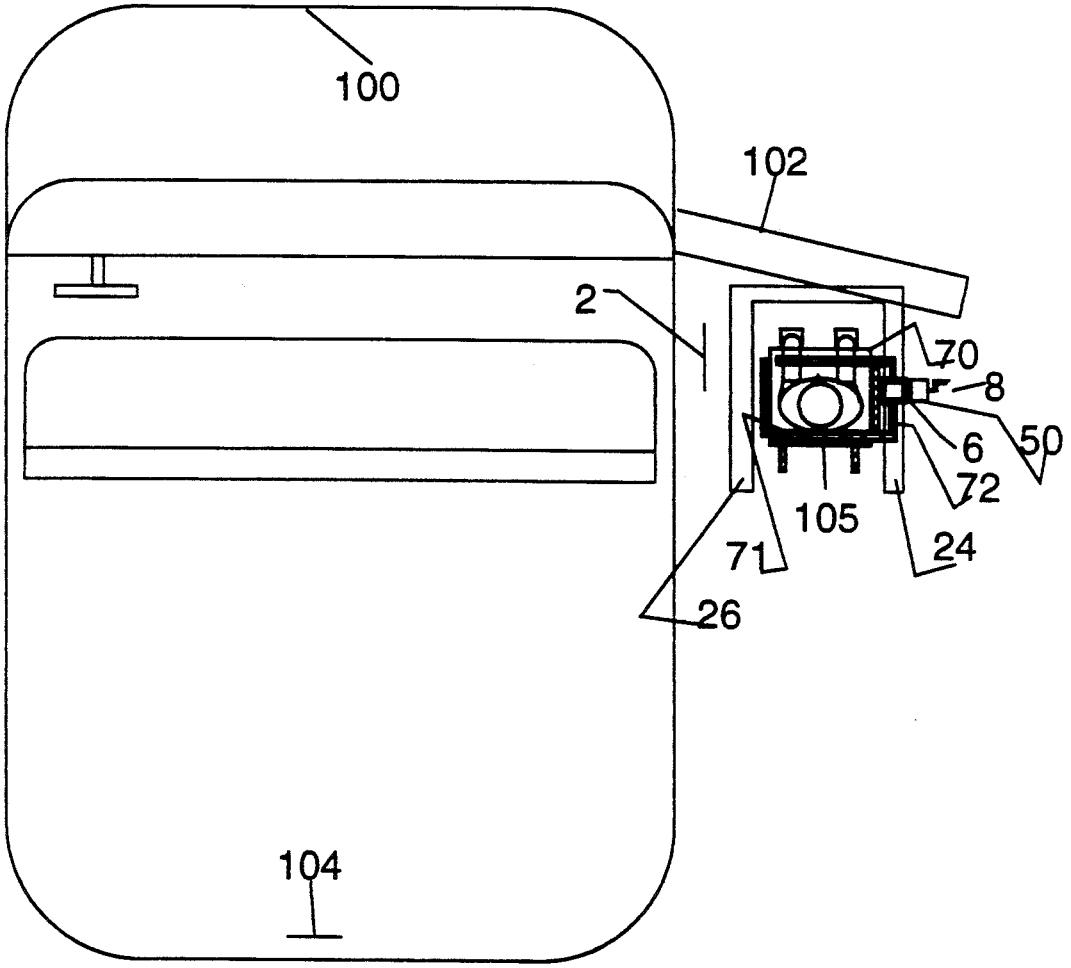
FIG. 3 is a top view of an automobile with the invention in position to transfer a wheelchair borne person.
Figure 4:
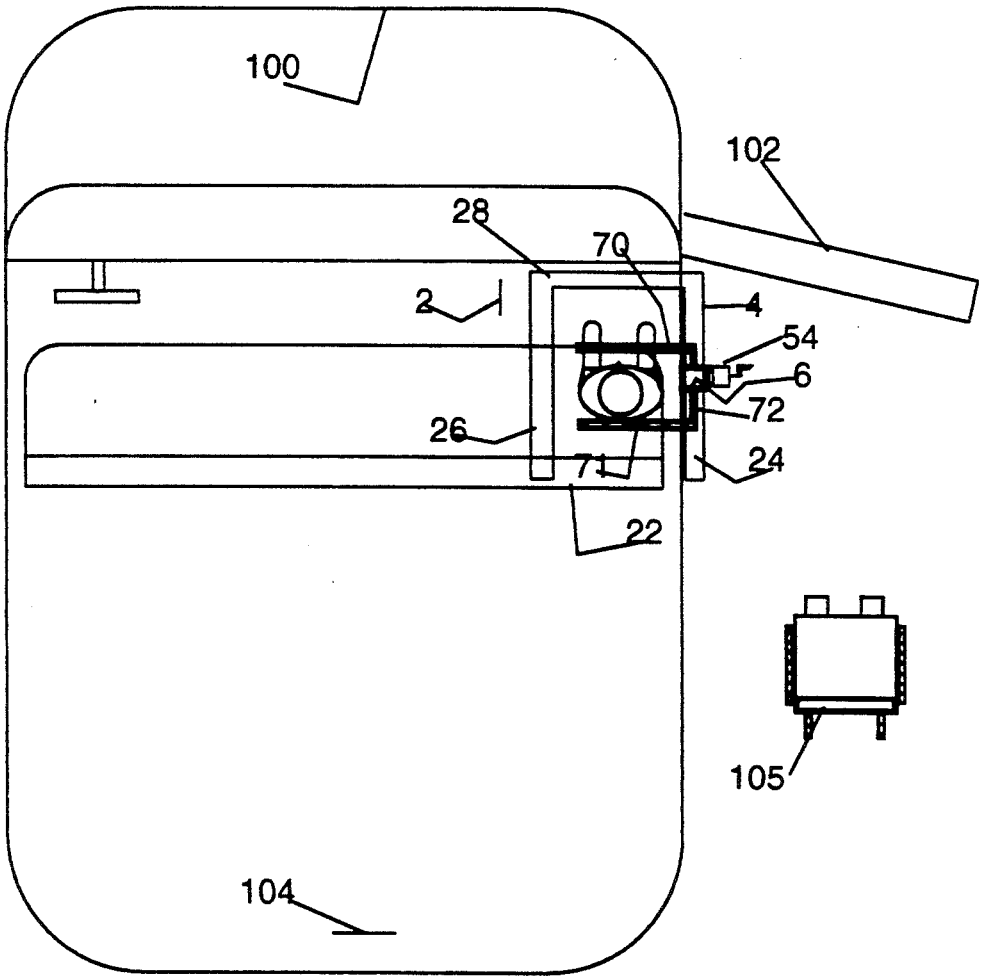
FIG. 4 is a top view of an automobile with the invention transfering a wheelchair borne person onto a seat.
Figure 5:
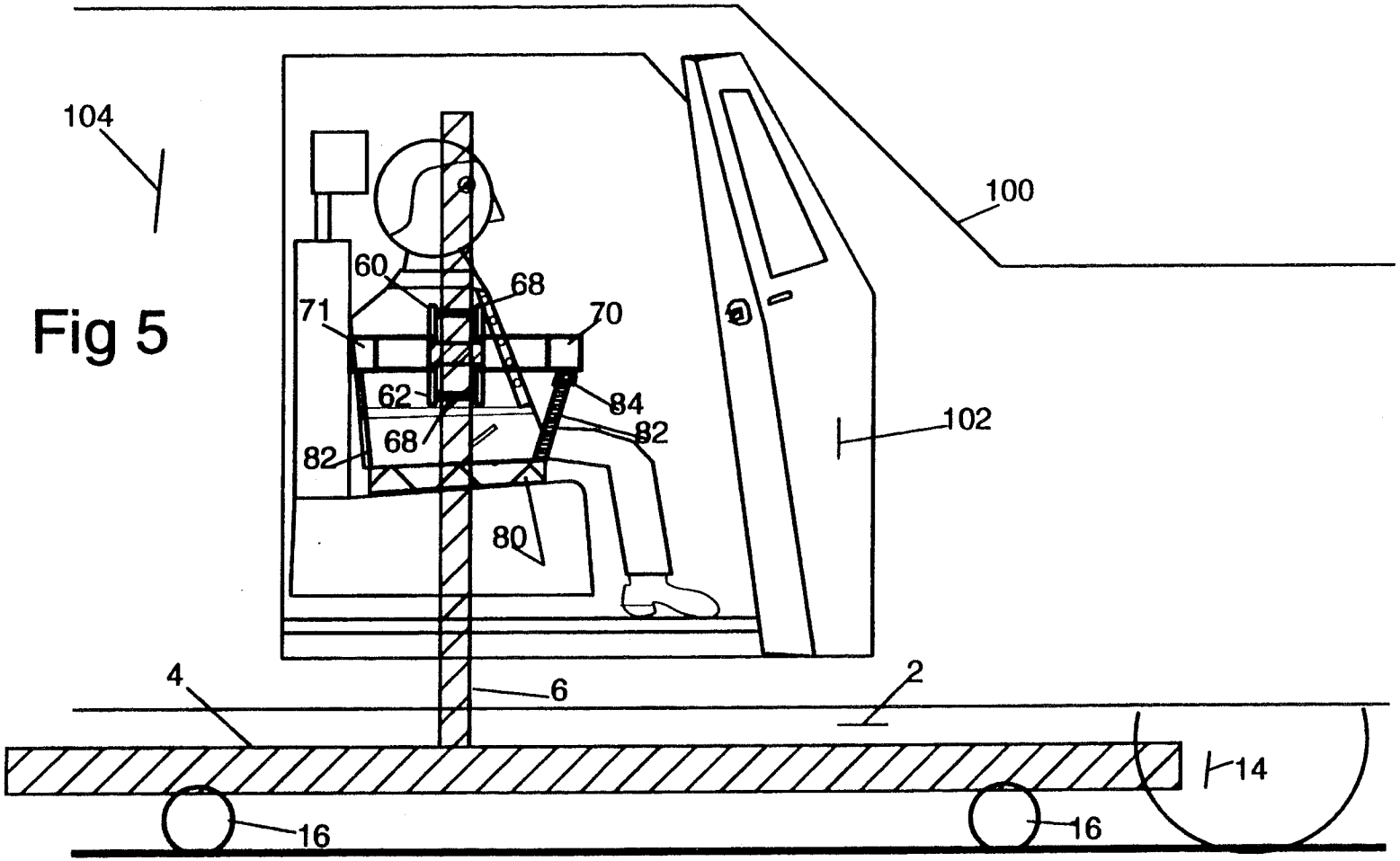
FIG. 5 is a side view of the invention transfering a person into an automobile.
Figure 6:
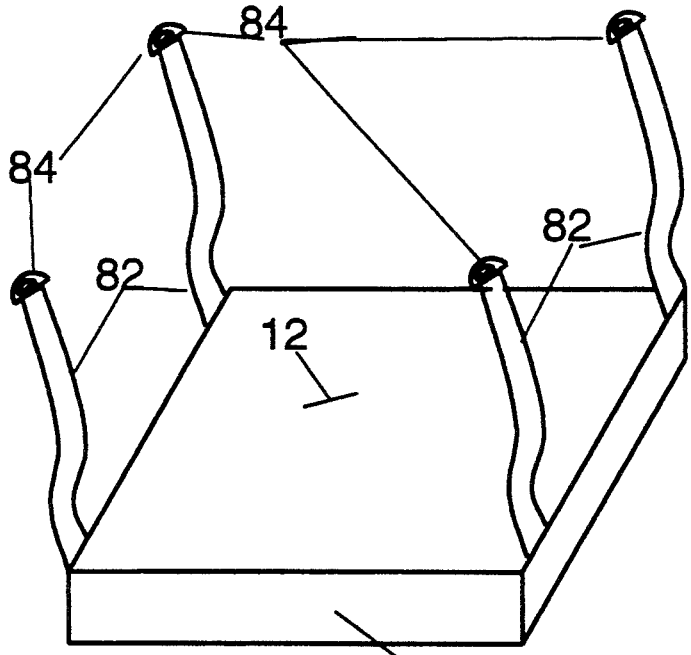
FIG. 6 is a view of the semi-rigid padded seat cushion of the invention.
Figure 7:
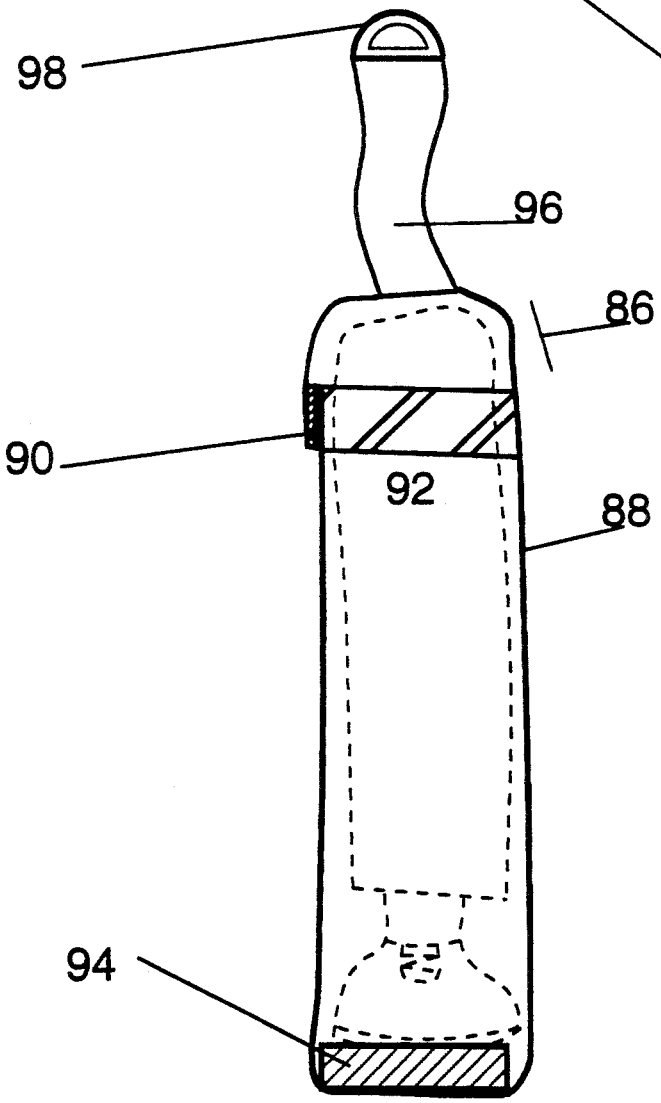
FIG. 7 is a view of the leg strap of the invention showing it fitting around a lower leg.
Figure 8:
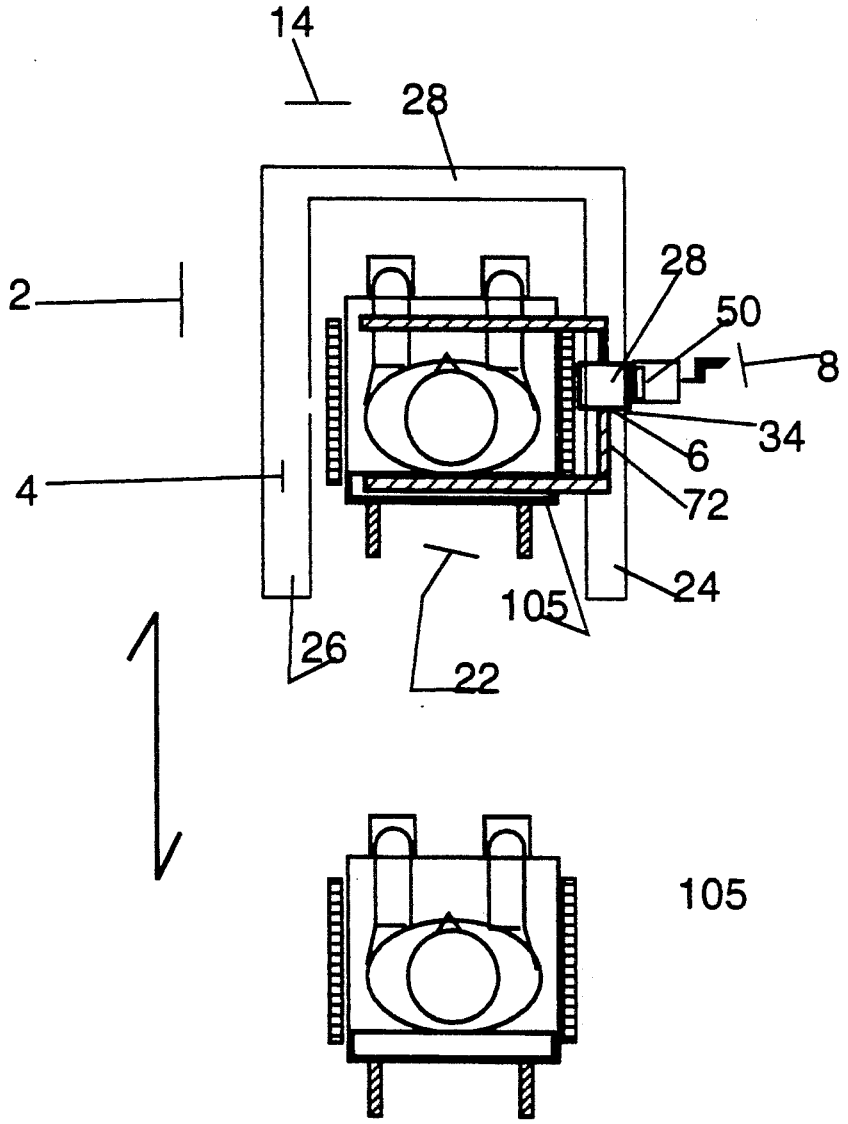
FIG. 8 is a top view showing a wheelchair borne person moving into the invention for lifting.

This transfer apparatus 2, as depicted in the figures, has five basic components: a base section 4, a jack tube 6; a jack assembly 8; an elevating fork assembly 10 and a sling cushion 12. The apparatus 2 is supported by a base section 4 upon which the remaining components are assembled.

The base section 4 is in form an open, U-shaped tubular structure having an open end 22, two parallel sides 24,26 joined and closed by a cross member 28 which form the front 14 of the apparatus.

This base section 4 is mounted on wheels or rollers 16 for easy movement across a level surface. The rollers are preferably swivel mounted so that the base 4 may be easily rolled in any direction without turning. In particular, it is important that the base 4 be able to be rolled forward and then, without turning, be rolled to the side.

Taking the closed end 28 of the base 4 to be the front 14, the parallel sides 24,26 may be defined as a right side bar 24 and a left side bar 26. Since, for all practical purposes, handicapped persons are almost always placed in and removed from an automobile or van from the Right, or Passenger side of the vehicle, the preferred embodiment has a matching orientation. However, in the description that follows, it is clear that the apparatus may be built in either a left or right handed manner, and it will be apparent that the device may be built to be used on the opposite side of the vehicle.

In the preferred form of the embodiment, a jacking shaft or stub 32 is vertically mounted at a point 34 substantially in the middle of the right side 24 of the base. Since it is desirable that the apparatus be easily disassembled for movement in the vehicle, the preferred form of stub 32 is a vertical, square jack tube support stub, typically 2 inches square and about one foot long welded to the base right side bar 24.

Mounted over this square stub 32, and extending upward for approximately four feet or so is a hollow square jack tube 6. This tube 6 is a close fit over the jack support stub 32, and is held in place by weight; no bolts of fastenings are used. Welded to a point on the lower portion of jack tube 6 is a jack support socket 40, an open upward facing socket, into which is inserted the vertical shaft 50 of the jack 8. Jack 8 comprises a self-contained jack, having a vertical shaft 50, on one face of which is a geared face or track 52. Mounted on vertical shaft 50, for jacked vertical motion therewith, is a jack box 54, containing a handcranked jack. Any jack mechanism is suitable, including hydraulic, so long as no back motion or uncommanded descent is possible under ordinary use. In this embodiment, the chosen mechanism is a screw driven jack in which a crank handle 56 turns a screw 58 which engages with the track 52 to drive the jack box 54 up or down the vertical shaft 50. The jack 8 is held in place by its weight in the socket 40, and by interlocking of the jack box 54 with the elevating fork collar 60, as described below; no fastenings are needed or used.

For safety, and due to the widely varying loads which may be encountered by users of the device, the jack box 54 preferably uses an internal recirculating screw mechanism, as such mechanisms are known to be resistant to motion under weight. However any jack mechanism which provides protection against being driven backwards under load may be used, including racheted gears or hydraulic mechanisms with suitable check valves. A rachet and pawl mechanism, such as are commonly found in automotive bumper jacks, is not recommended, due to its known risk of sudden descent.

It is thus seen that the jack box 54 may be driven or cranked up and down, parallel to the jack tube 6. On an inside face 55 of the jack box 54, facing towards the jack tube 6 and the interior of the base secion 4, is provided a hook 9, in the form of an upwardly extending flat plate.

This hook 9 engages with an elevating fork collar 60, which rides on, and encloses the jack tube 6. Elevating fork collar 60 is formed of two, spaced apart, facingly juxtaposed elevating plates 62, each having an upper end 64 and a lower end 65, and having an extension in their mid-section for mounting a jacking bracket 66. The plates 62 are spaced apart by four cylindrical nylon or metal bearing rollers 68 mounted between corresponding corners 69 of the plates 62. In form, the fork collar 60 is an open, rectangular collar which fits over and rides along the jack tube 6. A jacking bracket 66, in the form of a strap fixed between two plates 62, and extending between the plates 62, slides over the jack box hook, suspending the collar 60 and its associated elevating fork assembly 10 from the jack 8.

Two elevating fork bars 70,71 extend outward from the fork collar 60 over the base 4. The bars 70,71 are parallel to the front 14 of the apparatus and are spaced apart a distance substantially equal to the length of a standard wheel chair seat. The rear fork bar 71 is pivotally mounted to the fork collar 60, or to an extension tube 72 extending out from the fork collar 60, so that the pivoting fork bar 71 may be pivoted to a vertical position. Both bars 70,71 may be so pivoted. The elevated fork assembly 10 is held in position by weight on to the jack box; no bolts or fastenings are used.

At two spaced apart positions on each elevating fork bar 70 are mounted stirrup hooks 74. These may be any form of hook, stoutly mounted to the fork bar 70, preferably welded for strength.

A sling cushion 12 is provided, formed of a square self-supporting cloth seat pad 80. At the four corners of the seat pad 80 are sewn or strongly fastened cloth straps 82, each of equal length; each cloth strap 82 ends in a D-ring 84, and is sewn or strongly fastened to the D-ring 84.

An option addition to the apparatus 2 which in some circumstances will be beneficial, is a leg sling 86. When a disabled person has little or no use of the leg that will be nearest the door of the automobile, the leg and foot will dangle to the point that it would not pass over the threshold of an automobile door. To overcome this problem, an optional leg sling 86 is provided. This sling, which preferably is made of nylon, comprises a circular strap 88 which passes around and encompasses the arch of the foot of the individual passing over and also enclosing the leg above the knee. The length of the strap around the leg may be adjusted for an individual by two mating pieces of Velcro 90 permitting the size of the circular strap to be adjusted for any particular individual. A knee band 92 serves to restrain the leg from further motion and has been found beneficial to prevent the strap from falling off the leg. A rigid foot plate 94 in form and function identical to a rigid stirrup is optionally provided to aid in holding the foot within the circular strap 88. Rigid foot plate 94 is in simplest form a flat plate of plywood or similar material sufficiently small to fit under the foot but sufficiently large to provide for a comfortable lift and fastener inserted in the bottom of the strap 88. Attached to the upper end of strap 88 is a cloth strap 96 ending in a D-ring 98. As with the sling cushion 12, the cloth strap D-ring 98 may be attached to a stirrup hook 74 or a separate stirrup hook 74 may be provided on the top left end of the front elevating fork 70.

An important feature of the apparatus 2 described is that each component is mounted, by stacking it over the next lower item, and held by its weight to the apparatus without fastening. Equally, the apparatus 2 may be disassembled into its described component parts by successively lifting off each part, none of which are particularly heavy. As will be seen, this forms part of the unique functionality of the device.

In use, the user faces the problem of moving a wheel chair borne disabled person from a wheelchair to an automobile. Typically the user is a spouse, often aged or weak, and unable to move the disabled person without assistance. Equally, the user is unable to lift or manipulate heavy machinery.

The apparatus 2 described may be made of aluminum tubing or square stock, or of thin wall steel. In either case, the largest components, the base 4 and the elevating forks 10, are separate components, and in disassembled form, are relatively light weight. The use therefore starts by placing the base 4 next to the vehicle 100 adjacent an open door. The base is positioned with the open end 22 to the rear 104 of the vehicle, away from the open door 102.

The jack tube 6 is then placed over its mounting stub 32, and the jack 8 is inserted into the socket 40 on the jack tube. The elevating forks 10 are then lowered over the jack tube 6 until the jacking bracket 66 links over the jack box hook 9.

The disabled person is in a wheel chair 105 and is seated on the seat cushion 12. The rear elevating fork bar 71 is raised, and the wheelchair 105 rolled into the open U-shaped base 4. The elevating fork bar 71 is then lowered behind the disabled person.

The four D-rings 84 are then hooked to the four stirrup hooks 74 in the elevating fork bars 70,71. The cushion straps 82 may be adjustable in length but are typically made sufficiently short that the elevating fork bars 70,71 are positioned at chest height on the disabled person when the straps 82 are hooked up.

The user then cranks the jack 8. The jack box 54 may readily be made with a sufficiently high gear ratio that this cranking is not difficult, even for a weak user and a heavy disabled person. The disabled person is enclosed by the two chest high elevating forks 70,71, and is thus prevented from falling forward or backward. Placing the forks 70,71 at chest height additionally gives a feeling of safety and support to the disabled person, especially if that person has difficulty supporting his or her body in an upright posture.

Since the elevating forks 70,71 are below the head of the disabled person, it is necessary to crank up that person only a sufficient amount to remove their weight from the wheel chair 105; typically six or so inches is sufficient. The wheel chair 105 can then be rolled clear, and the apparatus 2 rolled under, moving the suspended person into the automobile. The disabled person, securely suspended on the cloth seat 12 between the elevating fork arms 70,71, is slid over the vehicle seat and lowered into place. The cloth straps 82 are unhooked from the elevating fork arms 70,71, the apparatus 2 rolled free of the car 100, and then disassembled by lifting off the component parts in reverse sequence of assembly. The separated components are easily lifted and stowed in the back or trunk of the vehicle, and the user may then drive off.

It can readily be seen how the process is done is reverse to remove a disabled person from a vehicle. It is clear how one person, even a weak person, can set up, use and take down the apparatus 2 without outside assistance. Equally, it should be noted that the structure of the invention permits a heavy person to be lifted without requiring any part of the apparatus 2 to be positioned over the top or head of the disabled person. It is this elimination of the overhead lift which makes it practical to use the apparatus 2 to slide a person into or out of a vehicle 100, where there is typically no excess vertical headspace for a lifting apparatus.

It is this particular functional advantage of the invention which has led to the above description of the preferred embodiment in terms of moving a disabled person into or out of a vehicle. However, it should be clear that the invention is of use for any movement of a disabled person by another who has no assistance. The invention is of particular utility for a spouse or sole attendant who lacks the strength to bodily lift the disabled person.

It can thus be seen that the invention extends beyond the preferred embodiment and exemplar usage described above to the wider range of equivalents as are embodied in the claims.

I claim:

1. An apparatus for transporting a disabled person comprising:

an open wheeled base having an open rear and closed front to receive a wheel chair to within said base through said open rear;

a fork spaced to enclose within the fork a person seated in a wheel chair which is positioned within said base;

means for jacking said fork with respect to said base;

means removably attachable to said fork for lifting the person from the wheelchair;

said fork being oriented parallel to the front of said base.

2. The apparatus of claim 1 above wherein said base comprises:

a U-shaped hollow tubular structure, having an open end and two sides a vertical stub arising from a mid point on one side of said base;

said means for jacking further comprising:

a vertical jack tube adapted to be supported on said stub by weight alone, said fork forming an enclosing collar which vertically rides on said jack tube;

a jack removably affixed between said tube and said collar for raising said fork.

3. The apparatus of claim 2 above further comprising:

a socket on said tube, removably receiving therein a bottom end of a jack, said jack comprising a vertical track, a jack box movably connected to said vertical track; and means interconnecting said jack box to said fork such that said fork rides vertically upon said jack box.

4. The apparatus of claim 2 above, said enclosing collar further comprising:

said jack being removably affixed to said vertical tube by:

a lower end of said jack being received within a fixed socket upon said vertical tube;

a second point on said jack being interconnected with a rolling collar upon said vertical tube for imparting vertical motion to said rolling collar.

5. The apparatus of claim 1 above wherein said means for supporting a person further comprises:

a seat pad having a resistance to bending;

said seat pad having corners thereof;

straps extending from said corners;

means within said straps for removably affixing said strap to said bar.

6. The apparatus of claim 5 above wherein said means for affixing comprises:

each said strap terminating in a ring;

a stirrup hook affixedly attached to said bars;

at least two stirrup hooks being affixed to each said bar.

7. An apparatus for transporting a disabled person comprising:

an open wheeled base having an open rear and closed front to receive a wheel chair to within said base through said open rear;

a fork spaced to enclose within the fork a person seated in a wheel chair which is positioned within said base;

means for jacking said fork with respect to said base;

means removably attachable to said fork for lifting the person from the wheelchair;

said fork being oriented parallel to the front of said base;

wherein said fork further comprises:

a first and a second spaced parallel bar;

means mounting said bars for relative motion vertically upon said vertical tube;

at least one of said bars being pivotally affixed to said means, said bar pivoting from between a substantially horizontal and a more vertical angled position.

8. An apparatus for transporting a disabled person comprising:

an open wheeled base having an open rear and closed front to receive a wheel chair to within said base through said open rear;

a fork spaced to enclose within the fork a person seated in a wheel chair which is positioned within said base;

means for jacking said fork with respect to said base;

means removably attachable to said fork for lifting the person from the wheelchair;

said fork being oriented parallel to the front of said base;

a circular strap adapted to enclose the lower leg portion of the disabled person;

said circular strap having an upper end defined adjacent to a knee region on a disabled person;

a band extending across said upper end of said circular portion adapted to enclose a knee;

a strap extending from said upper end a distance terminating in means for affixing to an enclosing fork.

9. The apparatus of claim 8 above said circular strap further comprising means for adjusting the length of said circular strap.

10. The apparatus of claim 8 above wherein said circular portion further comprises a support plate affixed to said circular strap distal of said upper end, adapted to support a foot.

11. An apparatus for transporting a disabled person comprising:

a base, having an opening adapted to receive a wheelchair therein supported by rollers for motion in at least two directions on a ground surface;

said opening defining a direction for rolling a wheelchair into said base a support stub arising vertically from said base;

a vertical tube slidably mounted on and enclosing said stub, retained thereon by weight;

a collar slidably, removably, mounted around said vertical tube and adapted for vertical motion thereupon;

two, substantially horizontal parallel bars, spaced a distance apart affixed to said collar;

said parallel bars extending across said base perpendicular to said direction for rolling a wheelchair;

means for moving said collar vertically along said tube;

a seat adapted to support a disabled person removably affixable to said bars.

12. The apparatus of claim 11 above, said bars further comprising:

at least one of said bars being pivotally affixed to said collar;

said bar pivoting from between a substantially horizontal position to a more vertically angled position.

13. The apparatus of claim 11 above, said seat comprising:

a seat pad having a resistance to bending;

said seat pad having corners thereof;

straps extending from said corners;

means within said straps for removably affixing said strap to said bars.

14. The apparatus of claim 13 above, said seat further comprising:

a circular strap adapted to enclose the lower leg portion of the disabled person;

said circular strap having an upper end defined adjacent to a knee region on a disabled person;

a band extending across said upper end of said circular portion adapted to enclosed a knee;

a strap extending from said upper end a distance terminating in means for affixing to an adjacent bar.

* * * * *